US007937223B2

(12) United States Patent
Ciglenec et al.

(10) Patent No.: US 7,937,223 B2
(45) Date of Patent: May 3, 2011

(54) DOWNHOLE FLUID ANALYSIS

(75) Inventors: Reinhart Ciglenec, Katy, TX (US); Stephane Vannuffelen, Southampton (GB); Akira Kamiya, Kanagawa-Ken (JP); Steven G. Villareal, Houston, TX (US); Tsutomu Yamate, Kanagawa-Ken (JP)

(73) Assignee: Schlumberger Technology Corporation, Sugar Land, TX (US)

( * ) Notice: Subject to any disclaimer, the term of this patent is extended or adjusted under 35 U.S.C. 154(b) by 475 days.

(21) Appl. No.: 11/965,770

(22) Filed: Dec. 28, 2007

(65) Prior Publication Data

US 2009/0166085 A1 Jul. 2, 2009

(51) Int. Cl.
*E21B 44/00* (2006.01)

(52) U.S. Cl. ..... 702/12; 702/9; 73/152.18; 73/152.55; 73/152.27; 166/250.01; 166/100; 166/313

(58) Field of Classification Search ..... 702/9, 12; 73/152.18, 152.55, 152.27; 175/24, 40, 49, 175/50, 59, 61; 166/250.01, 331, 100, 252.1, 166/250.07, 264, 266, 250.15, 313, 311, 166/250.03

See application file for complete search history.

(56) References Cited

U.S. PATENT DOCUMENTS

| | | | | |
|---|---|---|---|---|
| 4,860,581 | A | 8/1989 | Zimmerman et al. | |
| 5,201,220 | A | 4/1993 | Mullins et al. | |
| 5,594,706 | A * | 1/1997 | Shenoy et al. | 367/76 |
| 5,859,430 | A | 1/1999 | Mullins | |
| 5,934,373 | A * | 8/1999 | Warpinski et al. | 166/250.1 |
| 6,274,865 | B1 | 8/2001 | Schroer et al. | |
| 6,279,658 | B1 * | 8/2001 | Donovan et al. | 166/313 |
| 6,427,530 | B1 * | 8/2002 | Krueger et al. | 73/152.46 |
| 6,465,775 | B2 | 10/2002 | Mullins et al. | |
| 6,478,096 | B1 | 11/2002 | Jones et al. | |
| 6,704,109 | B2 | 3/2004 | Wu et al. | |
| 6,758,090 | B2 | 7/2004 | Bostrom et al. | |
| 6,939,717 | B2 | 9/2005 | Jiang et al. | |
| 6,986,282 | B2 * | 1/2006 | Ciglenec et al. | 73/152.51 |
| 7,445,043 | B2 * | 11/2008 | Mullins et al. | 166/250.01 |
| 7,558,675 | B2 * | 7/2009 | Sugiura | 702/9 |
| 7,717,172 | B2 * | 5/2010 | Sonne et al. | 166/264 |
| 2004/0231408 | A1 * | 11/2004 | Shammai | 73/152.27 |
| 2005/0072565 | A1 | 4/2005 | Segura et al. | |
| 2005/0257611 | A1 | 11/2005 | Fogal et al. | |
| 2007/0081157 | A1 * | 4/2007 | Csutak et al. | 356/301 |
| 2007/0187092 | A1 * | 8/2007 | Mullins et al. | 166/252.1 |
| 2008/0047751 | A1 * | 2/2008 | Yamate et al. | 175/50 |
| 2008/0083273 | A1 * | 4/2008 | Sroka et al. | 73/152.55 |
| 2009/0250264 | A1 * | 10/2009 | Dupriest | 175/40 |

FOREIGN PATENT DOCUMENTS

| | | | |
|---|---|---|---|
| GB | 2433274 | A | 6/2007 |
| WO | WO 98/42948 | A1 | 10/1998 |
| WO | 2007020492 | | 2/2007 |
| WO | WO 2007/146801 | A2 | 12/2007 |

* cited by examiner

*Primary Examiner* — Carol S Tsai
(74) *Attorney, Agent, or Firm* — Daryl R. Wright; Brigitte Jeffery Echols; Jeff Griffin

(57) ABSTRACT

A method that uses downhole fluid analysis in order to selectively collect and retain formation fluid samples in a drilling environment, as well as, control drilling using downhole fluid analysis.

23 Claims, 4 Drawing Sheets

DOWNHOLE FLUID ANALYSIS

FIELD OF THE DISCLOSURE

The present disclosure relates to downhole fluid analysis (DFA) in a drilling environment and its use for the control of the drilling and sampling process.

DEFINITION

Downhole as recited herein refers to a subsurface location inside a borehole.

BACKGROUND

In oilfield characterization, DFA has been mainly performed on a wireline platform and in openhole environments with fluid sampling tools such as Schlumberger's Modular Dynamic Tester (MDT) tool. For example, the Optical Fluid Analyzer (OFA), the Live Fluid Analyzer (LFA), and the Composition Fluid Analyzer (CFA) family of tools from Schlumberger performs composition analysis by optical spectroscopy.

DFA provides real time information on fluid properties which can be used to decide when the sample is worth taking and retrieving to the surface. The OFA, LFA, CFA family, for example, can perform an analysis of the level of contamination of the sampled fluid by the drilling mud having seeped into the formation. Based on this information, the engineer in charge of running the tool can decide whether the sample is worth taking or not, and thus adjust the pumping condition/time to improve sample quality.

DFA can also be used for the profiling of fluid properties without taking samples. Because the number of bottles on a tool string is limited, providing sample analysis without retrieving the sample to the surface makes it possible to increase the number of stations and have a very precise knowledge of the gradient of fluid properties as a function of depth. For example, on the same job, there can be one DFA station every 50 cm to obtain information about fluid properties in the formation for a better understanding of fluid communication within the formation (e.g. compartmentalization identification).

Currently, on a wireline platform, the downhole instrument sends back to the surface the raw data (optical absorption, fluid density, viscosity, pH, etc.). Thereafter, the interpretation of the data relies on algorithms implemented in the surface acquisition system resident at the surface. Some algorithms still require human interpretation and adjustment of parameters at the surface. In addition, decisions regarding the sampling process, tool/pump control and the like also rely on human input at the surface.

BRIEF DESCRIPTION

An objective of the present disclosure is to extend the concept of DFA to drilling applications and to use DFA for the control of, for example, the tool, the formation fluids sampling process, the formation fluids pumping process, the drilling process, based on downhole interpretation followed by downhole decision making. A system is provided for data communication to and from downhole and surface controllers such that various downhole tool components and/or modules in a tool string may be controlled based on real time DFA data acquired while drilling.

In one embodiment disclosed herein, a method for downhole fluid analysis according to the present disclosure includes collecting data about formation fluids and making decisions downhole about retention of fluid samples during drilling in order to control fluid sampling during drilling.

The tool for collecting data may include a Probe Module, a DFA Module, a Pumpout Module, and a Sample Carrier. In one embodiment, the DFA module can collect information about downhole fluid pressure and temperature, fluid density and viscosity, fluid electrical resistivity, fluid optical absorption, fluid emitted fluorescence light, $CO_2$ content, $H_2S$ content, fluid bubble point, fluid refractive index measurement, and information regarding flow line imaging.

In a tool according to the present disclosure, a fluid sampling tool controller makes decisions about whether to collect fluid samples. The fluid sampling tool controller may include a first memory device for storage of job control parameters, a second memory device for storage of collected data, a data pre-processor, a control algorithm bank, and a data compressor.

The first memory device may include information regarding one or a combination of maximum acceptable pumping time, required level of contamination, criteria on composition of a sample that is worthy of retention, criteria on sample integrity, a station where samples should not be taken, and the like. In one preferred embodiment, for example, fluid contamination level is used to determine whether to retain a fluid sample. In another embodiment, fluid phase behavior can be used to determine whether to retain a fluid sample.

The data compressor in the fluid sampling tool controller can compress data for transmission to the surface, the compressed data including one or more of tool status based on tool self-diagnosis capabilities, optical fluid analyzer status based on tool self-diagnosis capabilities, DFA data quality, DFA data quality trend, sample quality, sample quality trend, water fraction, oil fraction, oil color, gas to oil ratio, and the like.

A downhole fluid sampling tool according to one embodiment of the present disclosure may include a fluid sampling tool that includes at least one chamber for the retention of a fluid sample, and a fluid sampling tool controller operatively connected to the fluid sampling tool to receive data from the fluid sampling tool and to send control signals to the fluid sampling tool, wherein the fluid sampling tool and the fluid sampling tool controller are configured for downhole operation and the fluid sampling tool controller is configured to make decisions downhole and send control signals downhole related to the retention of fluid samples to the fluid sampling tool during drilling.

The fluid sampling tool may include a Probe Module, a DFA Module, a Pumpout Module, and a Sample Carrier. The DFA module can collect information about downhole fluid pressure and temperature, fluid density and viscosity, fluid electrical resistivity, fluid optical absorption, fluid emitted fluorescence light, $CO_2$ content, $H_2S$ content, fluid bubble point, fluid refractive index measurement, and flow line imaging.

The fluid sampling tool controller may include a first memory device for storage of job control parameters, a second memory device for storage of collected data, a data preprocessor, a control algorithm bank, and a data compressor.

The first memory device may include information regarding one or a combination of maximum acceptable pumping time, required level of contamination, criteria on composition of sample that is worthy of retention, criteria on sample integrity, a station where samples should not be taken, and the like.

The data compressor is for compressing data for transmission to the surface. The compressed data can include one or more of tool status based on tool self-diagnosis capabilities, optical fluid analyzer status based on tool self-diagnosis capabilities, DFA data quality, DFA data quality trend, sample quality, sample quality trend, water fraction, oil fraction, oil color, gas to oil ratio, and the like.

A tool according to the present disclosure may further include a master controller that sends control signals related to the operation of a drill based on information collected by the fluid sampling tool.

Other features and advantages of the present disclosure will become apparent from the following description of the disclosure which refers to the accompanying drawings.

DETAILED DESCRIPTION

In one respect, the present disclosure relates to the use of a DFA module in a drilling environment.

Figure 1:
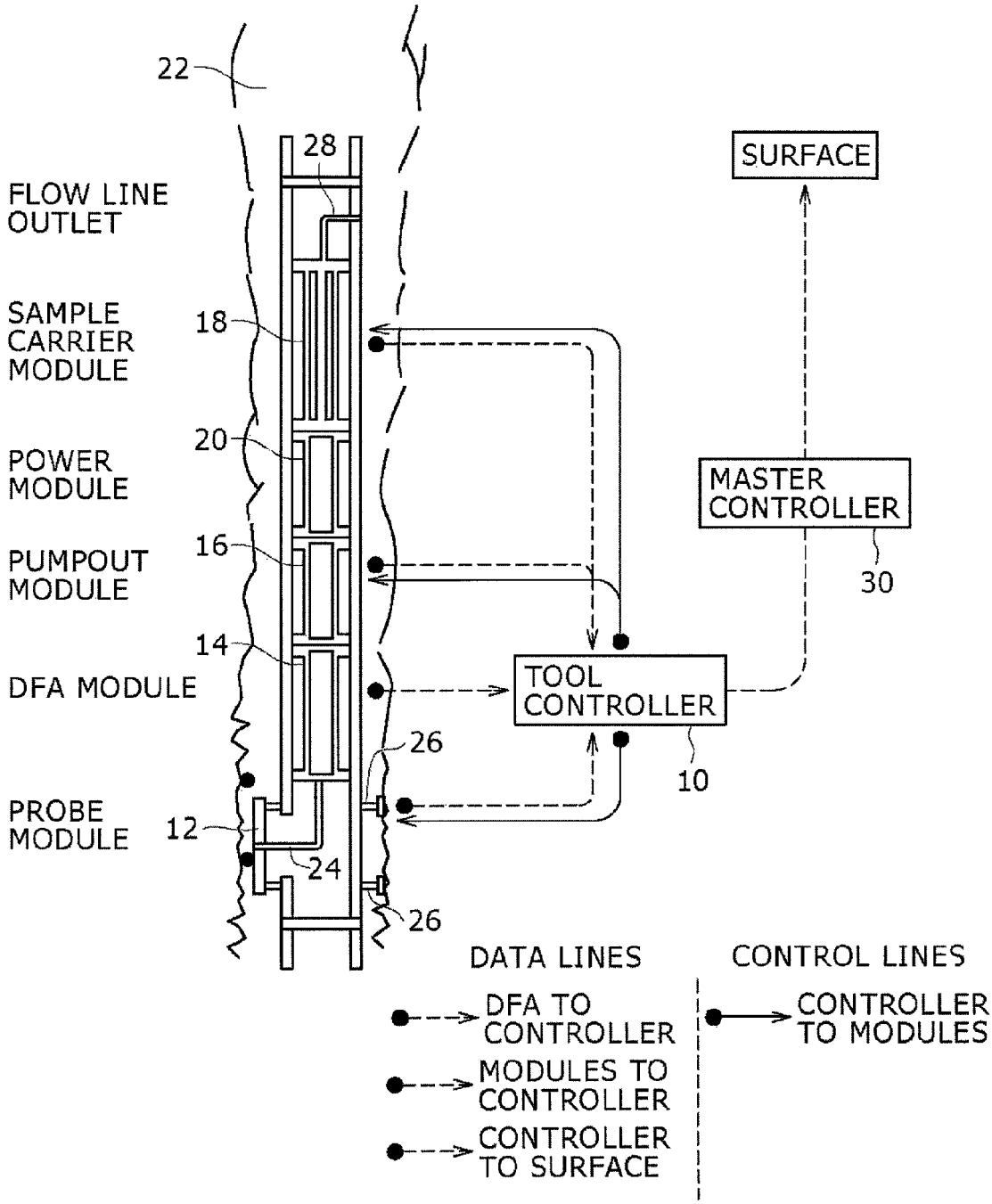
FIG. 1 schematically illustrates a downhole fluid sampling tool according to the present disclosure as would be deployed downhole to carry out a method according to the present disclosure.

Referring to FIG. 1, a downhole fluid sampling tool (DFST) according to the present disclosure includes a fluid sampling tool (FST), and a fluid sampling tool controller 10 that controls the operation of the FST in order to selectively obtain samples of formation fluids for retention during a drilling operation. In one embodiment herein, an FST includes a probe module 12, a downhole fluid analysis (DFA) module 14, a pump out module 16, and a sample carrier module 18. The DFST further includes a power module 20 to supply power to the FST and tool controller 10. Different modules can be in different collars. Thus, a tool according to the present disclosure can be modular. As a result, for example, DFA module 14 can be placed before or after pump out module 16, or several DFA modules 14 can be placed in the tool string. In this, the precise location of the DFA module is not limited to the disclosure herein since one or more DFA modules may be located at any location in the drill string that provides appropriate fluid analysis of the formation fluids. In one embodiment, the FST can include three complete and independent tools in respective drill collars. These tools may be a probe tool similar to a pressure while drilling tool, an integrated tool, which includes DFA module 14, pump out module 16, power module 20, and controller 10, and at least one sample carrier tool 18 (which may include its own controller and associated electronics).

As illustrated schematically by FIG. 1, the FST is implemented in a drilling collar and thus during the operation it resides within a bore hole 22 downhole. The FST operates as follows. Probe module 12 includes a flow line 24, which can be a tube or the like, that is isolated form the bore hole environment. Flow line 24 is placed in communication with the formation fluids. Probe module 12 may be secured in place during formation fluid collection using hydraulic jacks 26 which push probe module 12 against the sidewalls of the formation. U.S. Pat. No. 4,860,581 discloses the operation of a typical probe module. Flow line 24 is in communication with sample carrier module 18, the function of which is to retain selected samples of formation fluids. Sample carrier module 18 may contain several containers (e.g. bottles) for storage of selected formation fluids for surface retrieval once the DFST has been retracted. The function of pump out module 16 is to suck fluid through flow line 24 to sample carrier module 18. Note that DFA module 14 is disposed on the path of fluid flow from flow line 24 to sample carrier module 18. Thus, fluid collected by probe module 12 may be characterized (i.e. characteristics thereof can be determined through various tests) prior to the fluid reaching sample carrier module 18. Note that a tool according to the present disclosure includes a flow line outlet 28, which may be a pipe, a tube, or the like, serving to discard any collected fluid sample which is not selected for retention in sample carrier module 18.

According to an aspect of the present disclosure, tool controller 10 manages the operation of probe module 12 including hydraulic jacks 26, DFA module 14, pump out module 16, and sample carrier module 18.

It should be noted that the FST may be part of a more complex tool string with different other modules. In one preferred embodiment, the complete tool string can be controlled by master controller 30. Thus, master controller 30 can communicate with the local controller of one or more sub module(s) in the tool string (e.g. controller 10) and is also capable of communication with surface (telemetry) instruments. For example, techniques such as mud pulse telemetry, wired drill pipe, among other known methods for data communication in a while drilling environment may be used for the communication purposes described herein.

Thus, objectives of a method according to the present disclosure include pump and sample chamber control from the processing of the DFA module data output, and DFA module data conditioning and compression for transmission of data to the surface so that ongoing basic job parameters (e.g. sampled fluid composition or contamination) can be followed from the surface. Such data available to a driller on a real time basis would provide the driller with enhanced capability to make decisions regarding the drilling process and/or fluid pumping process.

Once information about the basic job parameters (e.g. fluid composition or contamination) are received at the surface, they can be used in the decision making process regarding the continuation of the sampling operation, and/or the continuation of the drilling operation.

During normal operation, the FST collects DFA measurements as a function of time. Data collected through measurement can include parameters such as fluid pressure and temperature, fluid density and viscosity, fluid electrical resistivity, fluid optical absorption as a function of wavelength (optical absorption spectroscopy) as disclosed, for example, in U.S. Pat. No. 5,859,430, fluid emitted fluorescence light as a function of wavelength (fluorescence emission spectroscopy) as disclosed, for example, in U.S. Pat. No. 6,704,109, $CO_2$ content, as disclosed, for example, in U.S. Pat. No. 6,465,775, $H_2S$ content, as disclosed, for example, in U.S. Pat. No. 6,939,717, fluid bubble point, fluid refractive index measurement, as disclosed, for example, in U.S. Pat. No. 5,201,220, flow line imaging, as disclosed in, for example, WO 2007020492, and the like.

For the purposes of controlling the sampling process, important parameters are fluid contamination level and fluid phase behavior.

Fluid optical absorption as a function of time can be a useful measurement because it allows for the estimation of the level of fluid contamination by the drilling mud filtrate and of the time necessary to recover a sufficiently clean formation fluid sample. This method has been widely used for wireline openhole fluid sampling and described in "Analysis of Downhole Formation Fluid Contaminated By Oil-based Mud", O. Mullins, B. Schroeder, U.S. Pat. No. 6,274,865B1.

Fluid density as a function of time can be a useful measurement also. A problem in fluid sampling operation is the sample integrity, i.e. the ability to sample without generating fluid phase transition. If the pump flow rate is too high, the pressure drop generated by the pump may lead to phase transition and gas which could have been dissolved in the liquid starts to form bubbles. Asphaltene precipitation could be another unwanted effect.

Strong fluid instability in turn would generate fluctuations of the fluid density, which could be used to detect a fluid flow condition in multiphase.

The density of drilling mud is different from the density of formation fluid. Usually, mud density is higher than the density of formation fluid to maintain pressure over-balance. Therefore, measuring the evolution of fluid density during pumping as a function of time can also be useful for the purpose of contamination monitoring.

Flow line imaging as a function of time is yet another useful measurement. Flow line optical imaging can be used to advantage to assess the fluid phase condition. Based on the direct optical image it is possible to see gas bubbles in the flow line, water slugs in oil, etc. The potential use of video imaging for downhole fluid characterization has been described in, for example, WO 2007020492. Through proper image processing, it is possible to extract the relative proportion of each present phase.

Mud coloration is usually different from formation fluid colors. Consequently, it is also possible to get an estimation of contamination by using a color measurement.

The combination of refractive index and fluorescence measurement is also known to be a powerful method to detect gas, oil and water in the flowline.

In addition, an estimation of fluid bubble point can be very useful for pump management in order to avoid crossing the phase boundary during the pumping process. Pumps are known to generate a pressure drop that could lead to phase transition. Downhole measurements of bubble point pressure have been described in "Bubble Point Measurement", for example, in U.S. Pat. No. 6,758,090.

Estimation of electrical resistivity is useful for fluid characterization. Water will usually have an electrical resistivity much smaller than oil and gas. Therefore, it can be used to discriminate between water and hydrocarbon phase.

Another important set of information obtained from the different sensors of the DFA module relates to self-diagnosis. For example, acquisition boards can include test signals that can be used to assess if they operate properly or not. Status of the different sensors can also be evaluated through their electrical consumption for example.

Figure 2:
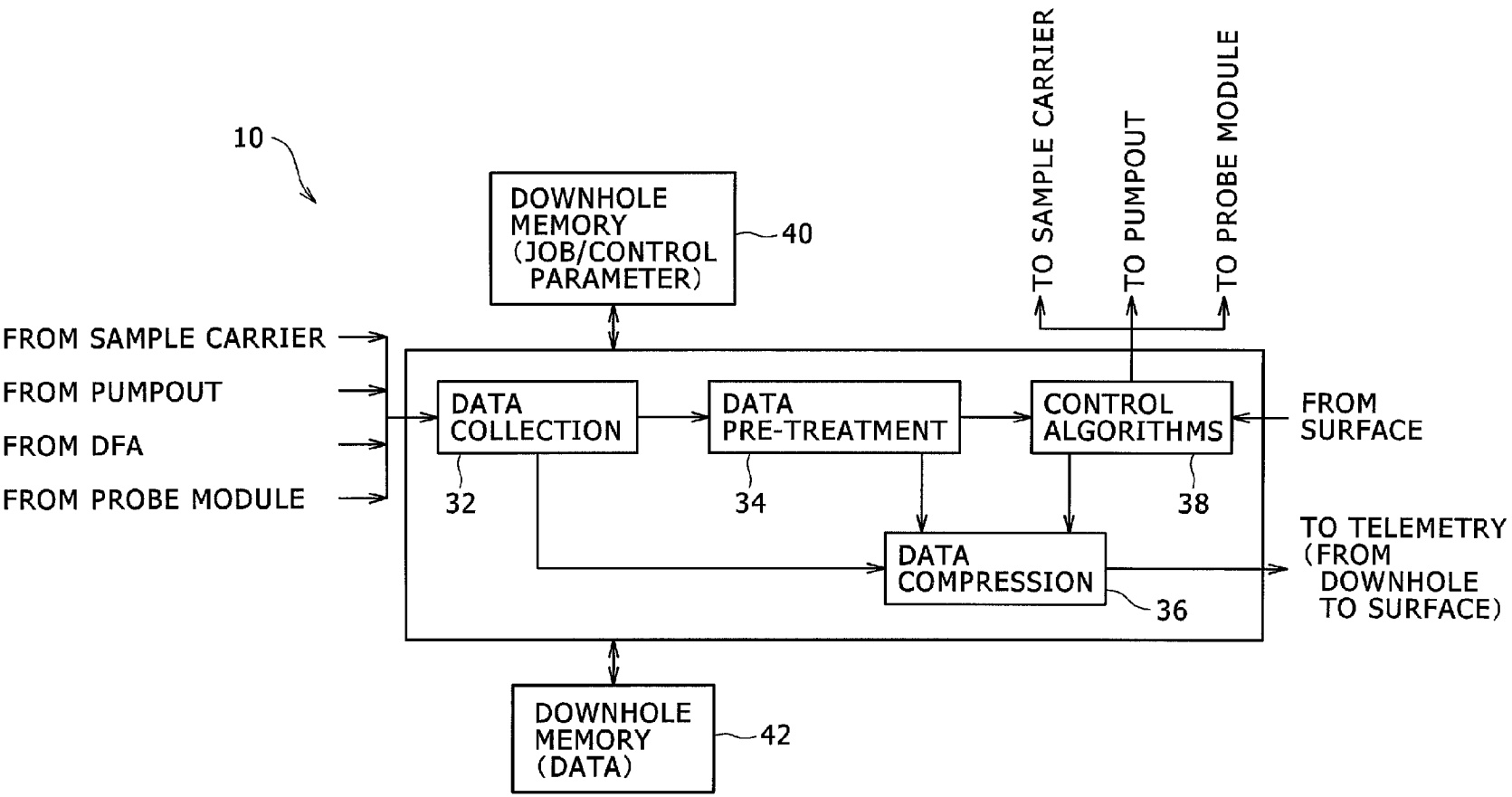
FIG. 2 schematically illustrates the constituents of a tool controller of a downhole fluid sampling tool according to the present disclosure.

Referring now to FIG. 2, tool controller 10 in a DFST according to the present disclosure includes a data collection facility 32 which receives information/data from sample carrier module 18, pump out module 16, DFA module 14 and probe module 12. Data collection facility 32 is in communication with data pre-treatment facility 34, as well as, a data compression facility 36. Data pre-treatment facility 34 is in communication with a control algorithms facility 38 as well as data compression facility 36. Control algorithm facility 38 is in communication with probe module 12, pump out module 16, and sample carrier 18, and also with telemetry equipment at the surface. Control algorithm facility 38 thus is capable of sending operational control signals to modules 12, 16, and 18. Through communication with surface facilities, control algorithm facility 38 is capable of receiving signals from the surface. Data compression facility 36 is also in communication with the surface telemetry equipment, whereby it is capable of sending data to the surface preferably in a compressed format. Tool controller 10 may further include two electronic memory facilities 40, 42. One electronic memory facility 40 may be configured to include data related to the applicable parameters for the performance of the job as well as job planning before the start of the operation of the tool. The other electronic memory facility 42 may be configured for the retention of data acquired during the operation of the tool that can be retrieved at the surface after the completion of the job.

The collected data needs to be pre-processed in order to extract the useful information from the raw data related to tool control. Pre-treatment facility 34 performs pre-processing operations on the data received from the FST.

Thus, pre-treatment facility 34 is loaded with interpretation algorithms. For example, pre-treatment facility 34 includes algorithms to extract contamination levels from optical absorption or density measurement as a function of time. A flow line (FL) image may also be processed in order to extract the fraction of different phases. The analysis of refractive index/FL as a function of time can be used for similar purposes.

The data interpretation output from pre-treatment facility 34 could include contamination level by drilling mud, water/Oil/Gas/Solid fraction in the flow line, bubble point, and the like.

Because fluid sensor performances can be affected by flow condition, phase behavior, and the like, the pre-processing stage can also include algorithms for data quality control in order to extract a quantitative indicator on the measurement quality.

For example, optical measurements such as absorption spectroscopy strongly depend on window cleanliness. A thin, optically absorbing film (e.g. a film of oil) on the windows can affect the measurement and lead to wrong interpretation of the data. Solid particles or tiny bubble in the flow line can also generate light scattering and make interpretation difficult. The assessment of window cleanliness could, for example, be performed through video imaging.

Specifically, a reference optical cell can be placed on the flow line with two optical windows, a light source and a video camera imaging the windows surface in contact with the fluid. The image can be processed to get an estimation of the total surface that is above a given level of darkness. This area can be designated as Scoated. Scoated will represent the surface coated by a residual contamination from the fluid. Sclean can be estimated similarly as Sclean=Stotal−Scoated where Stotal=total surface of windows image by the camera. Scoated/Stotal can be used as an estimator of the capability of the sample to coat optical windows. Sclean/Stotal can also be used as an indicator of window cleaningness. These parameters can then be used for the estimation of the level of confidence of the optics related measurement. Similar approach can be used to estimate solid particles as well as gas bubble concentration.

Surface coating could also affect optical absorption spectroscopy of FL measurement. With appropriate signal processing, as set forth above, it is possible to determine whether a surface is coated with oil and an estimation of its optical absorption.

Most optical measurements would be affected by a scattering effect due to the presence of bubble or solid particles. Density/viscosity sensors using a vibrating element are also known to be affected by the presence of solid particles. An appropriate signal processing, as set forth above, can also allow for the determination of the concentration of bubble and/or solid particles in the flow line as well as their size distribution.

As other optical sensors are located in the same module and in contact with the same fluid, their windows are likely to be affected in a similar manner. Therefore, these parameters can be used for an estimation of the quality of the optic measurements.

Another data quality indicator could be noise on the measurement. Estimation of signal to noise ratio can lead to a quantitative indicator on measurement quality. The quality control could, for example, consist of a statistical analysis of the noise on the raw measurement. As many interpretation models are linear, it is quite straightforward to estimate error propagation on the final parameters of interest and obtain an interval of confidence.

Data quality control can also use the module self-diagnosis capabilities. As explained before, it is possible, for example, to assess acquisition board status by using test signals. From such information, it is possible to confirm whether a sensor is operating properly and decide on the measurement quality.

Data quality control can result in a set of parameters related to the measurement quality of each sensor.

After pre-processing in the pre-treatment facility 34, the processed data and their quality control parameters are sent to control algorithms facility 38.

Before applying the control algorithms, an optional step can be evaluating the processed data in view of their quality control parameters. For example, the quality control parameters can be used to calculate a weighing parameter between 0 (no confidence) and 1 (highest confidence) for each processed raw data. Weighing parameters can be used by the control algorithms facility 38 to establish the relative weight of each measurement in the control process.

The weighing parameters depend on the quality control parameters. These relationships are pre-recorded in downhole memory 40 and/or also depend on the control algorithms stored in control algorithms facility 38. The relationship can be linear as well as non-linear. For example, a threshold quality parameter can be used as a threshold value in determining whether a data set should be used in the decision-making or control process. The weighing parameters can be obtained through modeling of sensor interaction with its environment (by analytic calculation or simulation) or derived from experimental correlations.

A control algorithms facility 38 can receive control commands from the surface. However, due to telemetry limitations in the drilling and measurement mud telemetry speeds, control commands from the surface to downhole tools are very restricted. Control commands from surface may be limited to a simple set of high level commands. These high level commands could trigger complex downhole routines as explained later.

Control algorithms facility 38 can also receive the processed raw data from DFA module with their weighing parameters. As just explained, due to telemetry limitations, sampling job control may mainly rely on processed raw data from DFA module 14 and the other modules.

Due to telemetry limitations, job planning parameters may be stored in downhole memory 40. Job planning parameters could include, for example, maximum acceptable pumping time, required level of contamination, and criteria on sample composition to decide whether it is worth opening a bottle. For example, a parameter can be included so that only in the presence of a certain percentage of hydrocarbons in the flow the sample is judged to be worth retention. Job planning parameters can further include criteria on sample integrity and station where samples should not be taken. For example, where DFA for wireline is used as a direct predictor of fluid composition without retrieving the sample to the surface (fluid scanning), fluid may be taken at some station and not at other one. Torque, speed and temperature limits for pump motor control, and the like are further job planning parameters.

Another feature of a tool according to the present disclosure is the transmission of data to the surface for job management. In a wireline environment, all the raw data can be retrieved at the surface with very limited data decimation or compression. Due to the telemetry limitations in D&M environment, data may need to be compressed to include the most essential information. The type of data transmitted to the surface could include tool status (Good/No Good), based on tool self-diagnosis capabilities, optical fluid Analyzer status (Good/No good), based on tool self-diagnosis capabilities, DFA data quality (High/Medium/Low/Impossible/NA), DFA data quality trend (Improving/Steady/Deteriorating/NA), sample quality (High/Medium/Low/NA), sample quality trend (Improving/Steady/Deteriorating/NA), water fraction, oil fraction, oil color, gas to oil ratio (GOR), and the like.

The calculation of these parameters results from the processing of the raw data either by data pre-treatment facility 34 or by the control algorithms facility 38.

Figure 3:
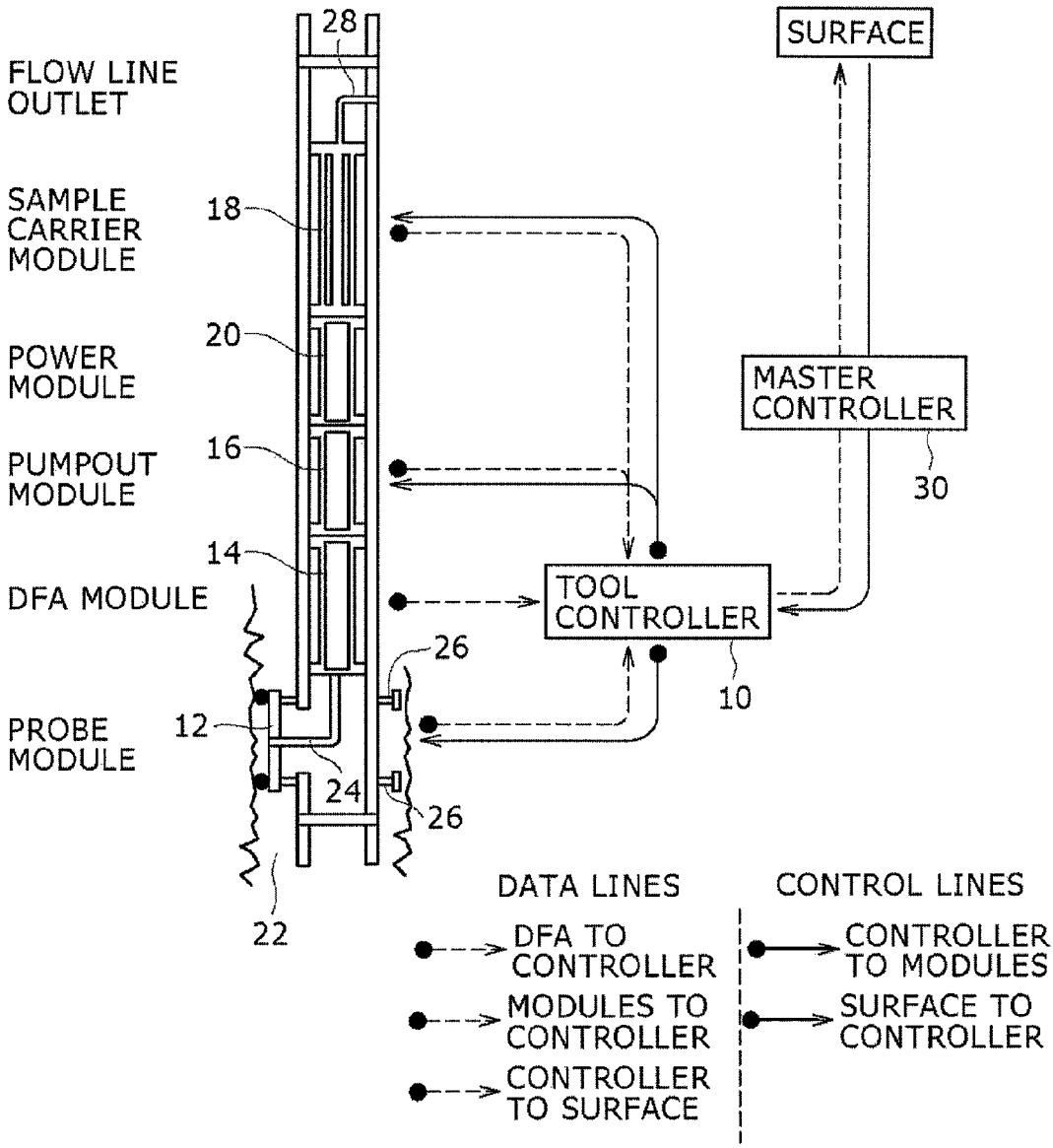
FIG. 3 schematically illustrates one mode of the operation of a tool according to the present disclosure.
Figure 4:
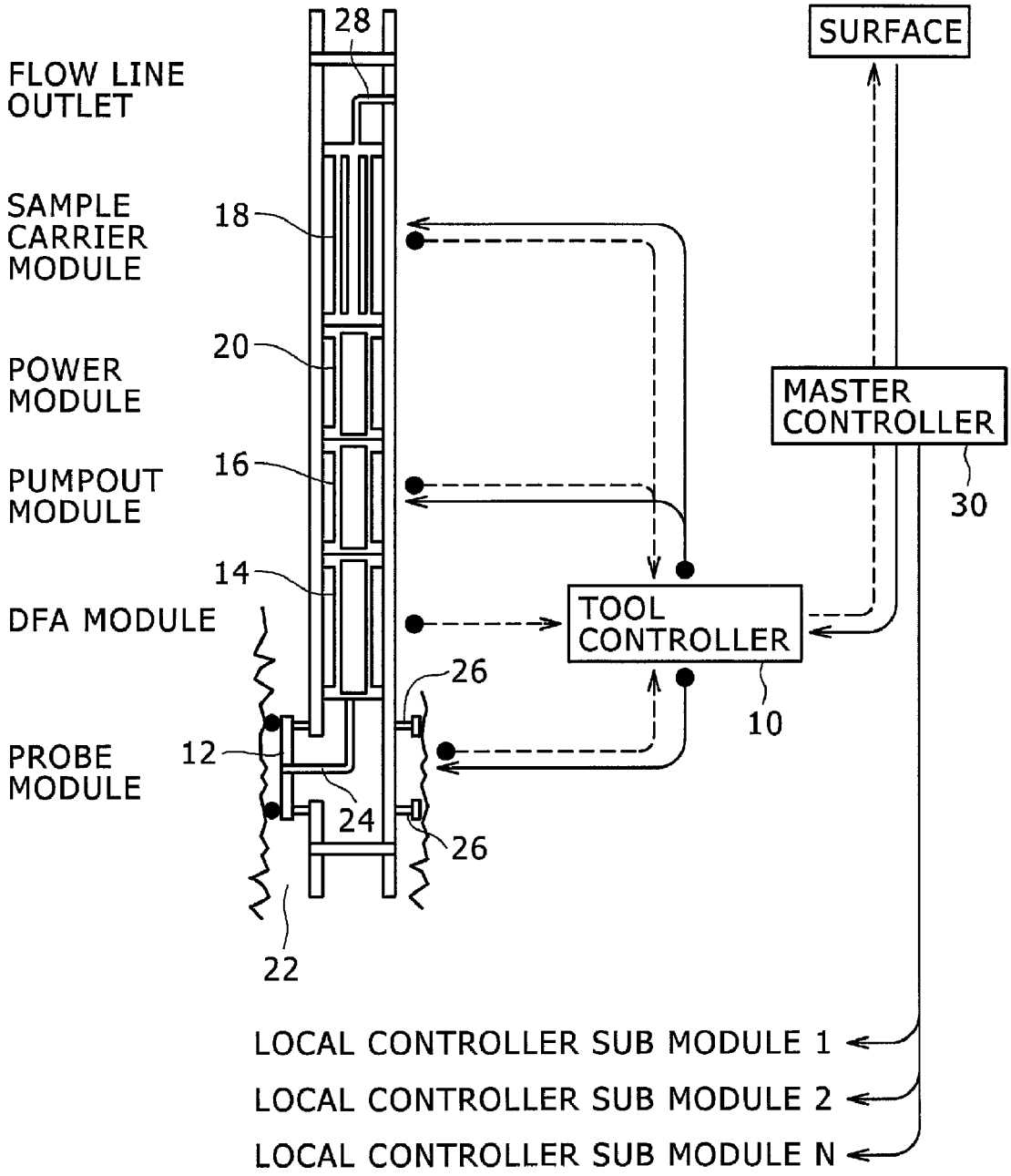
FIG. 4 schematically illustrates another mode of the operation of a tool according to the present disclosure.

In terms of tool control, the proposed architecture allows three types of control loops. The first two control loops are related to fluid sampling control. The third one is related to drilling process control. Note that the arrows in FIGS. 1, 3 and 4 illustrate the path and direction of information flow.

Control loop 1 is related to fluid sampling control and is schematically illustrated in FIG. 1.

In control loop 1, i.e. the fully automatic mode, control algorithms facility 38 relies solely on downhole processed raw data from DFA module and other modules to control the sampling job. Algorithms control facility 38 can control the deployment of probe module 12, the activation and flow rate of pump out module 16, the opening and closing of the sampling bottles of sample carrier module 18, the retraction of probe module 12, and the like.

In control loop 1, the only command from the surface is "Job start" and "Job abort".

Control loop 2 is related to fluid sampling control and is schematically illustrated in FIG. 3.

Control loop 2 is a semi-automated mode that may allow for manual operation by a user at the surface. As explained before, due to telemetry limitations, a purely manual mode for wireline operation is not possible because manual operation requires sending complex real-time commands that cannot be supported by the telemetry. However, it is still possible to send high level commands that would start a complex routine operating in a fully automated mode.

Such commands from the surface could include "Take sample", which directs the tool to automatically manage the opening and the closing of a sampling bottle in sample carrier module 18, "Deploy/Retract probe", and any command related to changing the job course compare to the initial plan. It could be, for example, "Pump longer" type command to force continued pumping for more time than initially planned. Preset contamination level could also be changed, as another example.

The decision related to commands in control loop 2 would be taken from the surface either through a surface control algorithm or human intervention. The decision would rely on the data from the DFA module sent to the surface through the telemetry, or pump parameters such as pump motor torque or speed, pump status, pump temperature, and the like.

Referring to FIG. 4, control loop 3 is related to the drilling process control. In this mode, information from DFA module 14 can be used to change the course of the drilling process. DFA information is preferably provided to the tool string master controller 30 and can include two control sub-loops.

In the first sub-loop of control loop 3, it is assumed that the DFST uses downhole control algorithms for the management of the drilling process with input from DFA module 14. Then master controller 30 dispatches the command lines down to the other modules to be controlled, based on DFA information.

As explained before, only a limited set of DFA data can be sent to the surface. However, they can be very useful to change job planning. Specifically, depending on fluid properties, it may be decided to change the drilling job course. Important information for the driller could be type of fluid (water/oil/gas), $H_2S$ content, etc.

In the second sub-loop of loop 3, decision regarding the continuation of the drilling process can be either made by a human or through on surface implemented algorithms. Real time DFA data can be correlated with real time measurement from other modules on the tool string or with information on the formation coming from wireline, seismic, etc.

Analysis of fluid properties as a function of depth can be used to either confirm or alter the drilling direction. Specifically, it is known that composition gradient can be used to identify reservoir compartmentalization. Therefore, information regarding reservoir compartmentalization can be used, for example, to drill in one given compartment. A possible sequence of events could be: make a station, start pumping followed by fluid analysis, verification of fluid content, and adjustment of drilling trajectory depending on the fluid content.

Although the present disclosure has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method for downhole fluid analysis comprising:

providing a fluid sampling tool within a downhole;

acquiring information about formation fluids collected by the fluid sampling tool during drilling;

analyzing the acquired information for making a decision about whether to retain collected fluid samples by using a fluid sampling tool controller; and controlling one or more downhole operations based on the decision, wherein said fluid sampling tool controller includes a first memory device for storage of job control parameters, a second memory device for storage of collected data, a data pre-processor, a control algorithm bank, and a data compressor, and wherein said first memory device may include information regarding one or a combination of maximum acceptable pumping time, required level of contamination, criteria on composition of a sample that is worthy of retention, criteria on sample integrity, and a station where samples should not be taken.

2. The method of claim 1, wherein said fluid sampling tool includes a Probe Module, a DFA Module, a Pumpout Module, and a Sample Carrier.

3. The method of claim 2, wherein said DFA module can collect information about downhole fluid pressure and temperature, fluid density and viscosity, fluid electrical resistivity, fluid optical absorption, fluid emitted fluorescence light, $CO_2$ content, $H_2S$ content, fluid bubble point, fluid refractive index measurement, and flow line imaging.

4. The method of claim 1, wherein said data compressor compresses data for transmission to the surface, said compressed data including one or more of tool status based on tool self-diagnosis capabilities, optical fluid analyzer status based on tool self-diagnosis capabilities, DFA data quality, DFA data quality trend, sample quality, sample quality trend, water fraction, oil fraction, oil color, and gas to oil ratio.

5. The method of claim 1, wherein a fluid sampling tool controller is used to makes a decision about optimizing pumping of the formation fluids.

6. The method of claim 1, wherein the controlling one or more downhole operations comprises using fluid contamination level to determine whether to retain a fluid sample.

7. The method of claim 1, wherein the controlling one or more downhole operations comprises using fluid phase behavior to determine whether to retain a fluid sample.

8. The method of claim 1, further comprising sending high level commands to said fluid sampling tool from surface.

9. The method of claim 8, further comprising communicating said collected information with the surface.

10. The method of claim 1, further comprising using information obtained by said fluid sampling tool in varying a drilling operation.

11. The method of claim 10, wherein said varying includes changing course of drilling.

12. The method of claim 10, wherein said varying includes interrupting drilling operation.

13. The method of claim 1, further comprising placing said fluid sampling tool into a drill string to reside within a borehole.

14. The method of claim 13, further comprising controlling other modules in the drill string based on the acquired information about formation fluids.

15. A downhole fluid sampling tool, comprising:

a fluid sampling tool that includes at least one chamber for the retention of a fluid sample; and a fluid sampling tool controller operatively connected to said fluid sampling tool to receive data from said fluid sampling tool and to send control signals to said fluid sampling tool;

wherein said fluid sampling tool and said fluid sampling tool controller are configured for downhole operation and said fluid sampling tool controller is configured to make a decision and send control signals related to retention of fluid samples to said fluid sampling tool during drilling wherein said fluid sampling tool controller includes a first memory device for storage of job control parameter, a second memory device for storage of collected data, a data pre-processor, a control algorithm bank, and a data compressor, and wherein said first memory device includes information regarding one or a combination of maximum acceptable pumping time, required level of contamination, criteria on composition of sample that is worthy of collection, criteria on sample integrity, and a station where samples should not be taken.

16. The tool of claim 15, wherein said fluid sampling tool includes a Probe Module, a DFA Module, a Pumpout Module, and a Sample Carrier.

17. The tool of claim 16, wherein said DFA module can collect information about downhole fluid pressure and temperature, fluid density and viscosity, fluid electrical resistivity,.fluid optical absorption, fluid emitted fluorescence light, $CO_2$ content, $H_2S$ content, fluid bubble point, fluid refractive index measurement, and flow line imaging.

18. The tool of claim 15, wherein said data compressor compresses data for transmission to the surface, said compressed data including one or more of tool status based on tool self-diagnosis capabilities, optical fluid analyzer status based on tool self-diagnosis capabilities, DFA data quality, DFA data quality trend, sample quality, sample quality trend, water fraction, oil fraction, oil color, and gas to oil ratio.

19. The tool of claim 15, wherein the operation comprises using fluid contamination level to determine whether to retain a fluid sample.

20. The tool of claim 15, wherein the operation comprises using fluid phase behavior to determine whether to retain a fluid sample.

21. The tool of claim 15, further comprising a master controller that sends control signals related to the operation of a drill based on information collected by said fluid sampling tool.

22. The tool of claim 21, wherein a trajectory of said drill is altered based on said collected information by said fluid sampling tool.

23. The tool of claim 15, wherein the tool is placed into a drill string to reside within a borehole.

* * * * *